US007773896B2

(12) United States Patent
Yagawara et al.

(10) Patent No.: US 7,773,896 B2
(45) Date of Patent: Aug. 10, 2010

(54) IMAGE FORMING APPARATUS AND TONER ADHESION AMOUNT CORRECTION METHOD

(75) Inventors: Makoto Yagawara, Ibaraki (JP); Hideharu Miki, Ibaraki (JP); Isao Nakajima, Ibaraki (JP); Akihiko Yamazaki, Ibaraki (JP); Akira Asaoka, Ibaraki (JP); Yukio Otome, Ibaraki (JP); Souichi Nakazawa, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 284 days.

(21) Appl. No.: 11/806,392

(22) Filed: May 31, 2007

(65) Prior Publication Data

US 2008/0044192 A1 Feb. 21, 2008

(30) Foreign Application Priority Data

Jun. 1, 2006 (JP) ..... P2006-153021
Mar. 6, 2007 (JP) ..... P2007-054977

(51) Int. Cl.
*G03G 15/00* (2006.01)

(52) U.S. Cl. ..... 399/49; 399/46

(58) Field of Classification Search ..... 399/46, 399/49, 50, 51, 53, 60
See application file for complete search history.

(56) References Cited

U.S. PATENT DOCUMENTS

| | | | | |
|---|---|---|---|---|
| 5,087,942 | A * | 2/1992 | Rushing | 399/53 X |
| 5,122,835 | A * | 6/1992 | Rushing et al. | 399/49 |
| 6,434,348 | B1 * | 8/2002 | Tomizawa | 399/49 X |
| 6,633,734 | B2 * | 10/2003 | Maebashi et al. | 399/49 |
| 6,804,479 | B2 * | 10/2004 | Kimura | 399/49 |
| 7,162,171 | B2 * | 1/2007 | Sugiyama | 399/49 |
| 7,194,214 | B2 * | 3/2007 | Takahashi | 399/49 |
| 7,324,769 | B2 * | 1/2008 | Yamaoka | 399/49 |
| 2007/0212086 | A1 | 9/2007 | Yagawara et al. | |

FOREIGN PATENT DOCUMENTS

| | | |
|---|---|---|
| JP | 2003-186278 | 7/2003 |
| JP | 2006-084796 | 3/2006 |
| JP | 2007-272193 | 10/2007 |

* cited by examiner

*Primary Examiner*—Sandra L Brase
(74) *Attorney, Agent, or Firm*—McGinn IP Law Group, PLLC

(57) ABSTRACT

According to one embodiment, an image forming apparatus includes an image carrier, a image forming unit, a measurement unit and a controller. The image carrier includes a central region on which a target image as an object of an image forming is formed and a peripheral region placed outward of the central region. The image forming unit forms a reference image on the peripheral region and the central region, before the image forming is started. Also, the image forming unit forms the target image on the central region based on a preset condition and a third reference image on the peripheral region, during the image forming. The measurement unit measures a physical quantity for the reference images.

9 Claims, 7 Drawing Sheets

IMAGE FORMING APPARATUS AND TONER ADHESION AMOUNT CORRECTION METHOD

CROSS-REFERENCE TO RELATED APPLICATIONS

This application is based upon and claims a priority from prior Japanese Patent Application No. 2006-153021 filed on Jun. 1, 2006 and from prior Japanese Patent Application No. 2007-054977 filed on Mar. 6, 2007, the entire contents of which are incorporated herein by reference.

BACKGROUND OF THE INVENTION

1. Field of the Invention

An aspect of the present invention relates to an image forming apparatus and a toner adhesion amount correction method.

2. Description of the Related Art

As a color image forming apparatus of an electronic picture system, a tandem system is known where an image forming part for each of the colors yellow (Y), magenta (M), cyan (C) and black (K) is arranged along a belt-shaped intermediate transfer body.

The image forming part for each color includes a photoreceptor and a charger, an exposure unit, a developing unit and a photoreceptor cleaner arranged around the photoreceptor. The surface of the photoreceptor is uniformly charged by the charger and the charged part is exposed by laser beams emitted from the exposure unit. This forms an electrostatic latent image on the photoreceptor and a toner image corresponding to the electrostatic latent image is formed by the developing unit.

When the intermediate transfer body is conveyed to the first image forming part (yellow), the toner image on the photoreceptor is transferred. The intermediate transfer body is sequentially fed to the other image forming parts, where toner images of other colors are transferred one over another. The photoreceptor where transfer is over has unnecessary toner remaining on its surface. The unnecessary toner is removed by the photoreceptor cleaner for formation of a next image.

In this way, toner images of respective colors formed one over another are transferred to print paper as a recording material and the print paper with the toner images fixed thereon is ejected.

In such an image forming apparatus, degradation or a secular variation of an image carrier including a photoreceptor, an intermediate transfer body and a recording material results in a smaller amount of toner adhesion to the image carrier thus causing degradation in the printing quality. For example, JP-A-2003-186278 and JP-A-2006-84796 disclose methods for correcting toner adhesion amount.

FIG. 5 illustrates an exemplary toner adhesion amount correction method according to the related art in cure paper printing.

The toner adhesion amount correction method corrects toner adhesion amount based on the detection result of an adhesion amount sensor 12 for printing out a correction toner image 15 inside the maximum form area 5B in a direction orthogonal to the carrying direction of an intermediate transfer body 5 (direction of width of the intermediate transfer body 5) at the start of printing and optically measuring the toner adhesion amount of the correction toner image 15. FIG. 5 also show a photoreceptor 2.

In FIG. 5, a sign 5A represents the outer region the maximum form area 5B. The maximum form area 5B refers to the maximum print width where toner image transfer to a recording material is available in the width direction of the intermediate transfer body 5. The outer region 5A of the maximum form area 5B refers to the region of an intermediate transfer body not involved in toner image transfer to the recording material in the width direction of the intermediate transfer body 5.

The toner adhesion amount correction method in the cut paper printing assumes that the image forming area on the intermediate transfer body 5 includes a space between pages. The method forms a correction toner image 15 to correct the toner adhesion amount in the center of the space between pages and performs correction control in accordance with a detection signal from the adhesion amount sensor 12.

In case a web that is continuous in the shape of a belt is used as a recording material and continuous printing is made on the web, no space between pages exists in the image forming area on the intermediate transfer body 5. Thus, printing on a web must be suspended in order to print a correction toner image 15 inside the maximum form area 5B on the intermediate transfer body 5 and optically measure the correction toner image 15 to correct the toner adhesion amount. In other words, when a correction toner image 15 is formed inside the maximum form area 5B of the intermediate transfer body 5 while continuous web printing is on the way, it is not possible to remove the correction toner image 15 before transfer to the web, thus staining the web. As a result, the printing efficiency drops.

A method is also known for printing a correction toner image 15 in the outer region 5A of the maximum form area on the intermediate transfer body 5 to solve the problems.

In this case, it is possible to perform correction control of toner adhesion amount during continuous web printing. That is, based on a detection signal from the adhesion amount sensor, setting of the charging voltage is corrected with timing that the position corresponding to a space between pages reaches just below the charger, and setting of the development bias voltage is corrected with timing that the position reaches just below the developing unit, and setting of the exposure amount is corrected with timing that the space reaches just below the exposure unit to make toner adhesion amount correction. With this method, it is possible to make control of the toner adhesion amount without lowering the printing efficiency.

However, in the related art, a difference between the toner adhesion amount outside the maximum form area on the intermediate transfer body and that inside the intermediate transfer body in order to print a correction toner image, if any, could affect the printing quality. This is mainly due to the fact that, when a secondary transfer is made from an intermediate transfer body to a web during continuous web printing, the resistance value of the intermediate transfer body is subjected to a secular variation since the intermediate transfer body has a surface that comes into contact with the web and another that does not. When the resistance value of the intermediate transfer body changes, the transfer efficiency of the first transfer differs between outside the maximum form area and inside the maximum form area, thus resulting in a difference in the toner adhesion amount.

As described in JP-A-2006-84796, there is proposed an image forming apparatus that regularly performs image quality control based on a correction toner image formed in the regions at both ends of the web in its width direction and that performs image quality control with the position where the correction toner image is formed switched in the center of the web in its width direction when the measurement value of the correction toner image is out of a permitted range.

In the case of JP-A-2006-84796, printouts from the image forming apparatus include a page including a correction toner image formed in each of the regions at both ends of the web in its width direction and a page including a correction toner image formed in the center of the web in its width direction.

It is thus necessary to store the history of switching the position where a correction toner image is formed and switch web cutting processing based on the history information. This lowers the printing efficiency.

SUMMARY OF THE INVENTION

According to an aspect of the present invention, there is provided an image forming apparatus including an image carrier that includes: a central region on which a target image as an object of an image forming is formed, and a peripheral region placed outward of the central region; a image forming unit that forms: a first reference image on the peripheral region and a second reference image on the central region, before the image forming is started, and the target image as the object on the central region based on an image forming condition preset for the image forming and a third reference image on the peripheral region, during the image forming; a measurement unit that measures a physical quantity of the first reference image, the second reference image and the third reference image; and a controller that corrects the image forming condition based on the physical quantity measured by the measurement unit.

The image carrier may include a photoreceptor, an intermediate transfer body, or recording paper.

Each of the first reference image, the second reference image and the third reference image may include a toner image. The measurement unit may include a toner sensor that senses a toner adhesion amount of the toner image formed on the image carrier. The physical quantity may include the toner adhesion amount of the first reference image, the second reference image and the third reference image, which are sensed by the toner sensor.

According to another aspect of the present invention, there is provided an image forming apparatus including: an image carrier that includes: a central region on which a target image as an object of an image forming is formed, and a peripheral region placed outward of the central region; an image forming unit that includes: a photoreceptor, a charging unit that uniformly charges a surface of the photoreceptor, a exposure unit that forms an electrostatic latent image on the surface by irradiating a laser beam, and a developing unit that forms a toner image corresponding to the electrostatic latent image on the surface; and forms: a first reference toner image on the peripheral region and a second reference toner image on the central region, before the image forming is started, and a target toner image corresponding to the target image on the central region based on an image forming condition preset for the image forming and a third reference image on the peripheral region, during the image forming; a measurement unit that measures a toner adhesion amount of the first reference toner image, the second reference toner image and the third reference toner image; and a controller that corrects the image forming condition based on the toner adhesion amount measured by the measurement unit.

The measurement unit may measure: the toner adhesion amount of the first reference toner image as a first toner adhesion amount; the toner adhesion amount of the second reference toner image as a second toner adhesion amount; the toner adhesion amount of the third reference toner image as a third toner adhesion amount. The controller may calculate an toner adhesion amount ratio that is a ratio between the first toner adhesion amount and the second toner adhesion amount. The controller may control the image forming unit to form a next target image by compensating the toner adhesive amount to be included in the next target image based on the toner adhesion amount ratio and the third toner adhesion amount.

The image forming unit may compensate the toner adhesive amount of the next target image by controlling: the exposure unit; the developing unit; and the charging unit.

According to still another aspect of the present invention, there is provided a toner adhesion amount correction method for compensating a toner adhesion amount of a toner image formed by an image forming apparatus including: an image forming unit that forms the toner image, and an intermediate transfer body that includes a central region on which a target image as the object of an image forming is formed and a peripheral region placed outward of the central region and transfers the toner image formed on the central region by the image forming unit onto a recording medium, the method including: (a) forming a first reference toner image on the peripheral region of the intermediate transfer body; (b) forming a second reference toner image on the central region of the intermediate transfer body; (c) detecting the toner adhesion amount of the first reference toner image as a first toner adhesion amount; (d) detecting the toner adhesion amount of the second reference toner image as a second toner adhesion amount; (e) calculating a toner adhesion amount ratio that is a ratio between the first toner adhesion amount and the second toner adhesion amount; (f) forming a third reference toner image on the peripheral region; (g) detecting the toner adhesion amount of the third reference toner image as a third toner adhesion amount; and (h) estimating the toner adhesion amount of the target image formed on the central region as a fourth toner adhesion amount based on: the toner adhesion amount ratio, and the third toner adhesion amount.

The toner adhesion amount correction method may include (i) controlling the image forming unit to form a next target image by compensating the toner adhesive amount to be included in the next target image based on the fourth toner adhesion amount.

The image forming unit may includes a photoreceptor, a charging unit that uniformly charges a surface of the photoreceptor, a exposure unit that forms an electrostatic latent image on the surface by irradiating a laser beam, and a developing unit that forms a toner image corresponding to the electrostatic latent image on the surface. The image forming unit may compensate the toner adhesive amount of the next target toner image by controlling: the exposure unit; the developing unit; and the charging unit.

According to an aspect of the present invention, an image forming apparatus that assures good printing quality without suspending a printing process and a toner adhesion amount correction method therefor are provided.

BRIEF DESCRIPTION OF THE DRAWINGS

Embodiments of the present invention will be described in detail based on the following figures, wherein.

DETAILED DESCRIPTION OF THE INVENTION

An embodiment of the image forming apparatus according to the invention will be described referring to FIG. 1.

Figure 1:
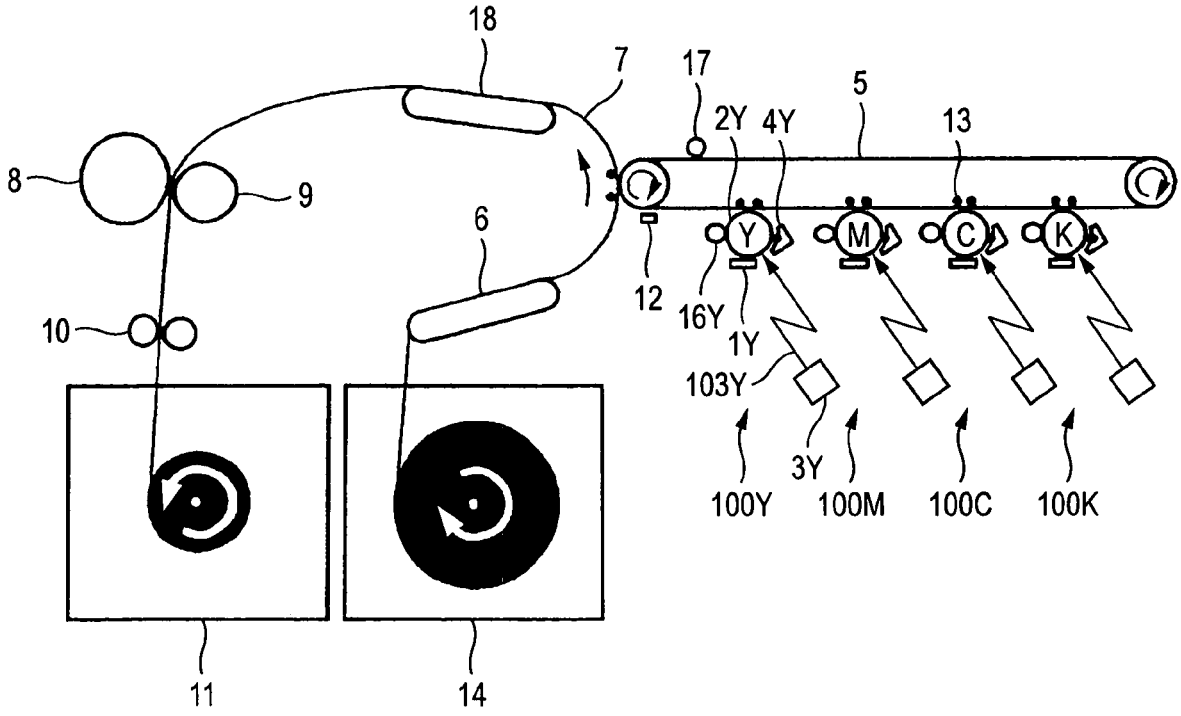
FIG. 1 is a general configuration diagram showing an exemplary embodiment of an image forming apparatus according to the invention.

As shown in FIG. 1, there are arranged an image forming part 100Y of yellow (Y), an image forming part 100M of magenta (M), an image forming part 100C of cyan (C), and an image forming part 100K of black (K) along an intermediate transfer body 5. These image forming parts 100Y, 100M, 100C and 100K have the same internal configuration except for the color of toner. Thus, the image forming part 100Y of yellow (Y) will be described as a typical example.

The image forming part 100Y includes a charger 1Y, a photoreceptor drum 2Y, an exposure unit 3Y, a developing unit 4Y and a cleaner 16Y. The photoreceptor drum 2Y is uniformly charged by the charger 1Y and exposed to laser beams 103Y corresponding to the yellow image information corresponding to the exposure unit 3Y to form an electrostatic latent image. The electrostatic latent image is turned into a visible image by the yellow toner in the developing unit 4Y and a toner image of yellow (Y) is formed on the photoreceptor drum 2Y. The toner image is transferred to an intermediate transfer body 5 in a transfer position where the photoreceptor drum 2Y comes into contact with the intermediate transfer body 5. When transfer of the toner image is complete, unnecessary toner remaining on the surface of the photoreceptor drum 2Y is removed by the cleaner 16 for formation of a next image.

In the same way, toner image of magenta, cyan and black are transferred one on another to the intermediate transfer body 5 to form a color image. A sign 13 represents a retractor and 17 a cleaner for removing unnecessary toner on the intermediate transfer body 5.

The web 7 is fed to a secondary transfer position from a web feeding device 14 by a web carrying unit 6. A color image formed on the intermediate transfer body 5 is transferred to the web 7 in the secondary transfer position where the intermediate transfer body 5 comes into contact with the web 7.

The color image on the web 7 is then guided, via a web carry unit 18, to a fixing device which includes a heating roller 8 and a pressing roller 9. The web 7 having the color image transferred and fixed is guided to a web winding device 11 via a puller roller 10.

According to the embodiment, a reference image may be formed on any one of the image carriers including a photoreceptor drum, an intermediate transfer body and a recording material. In this embodiment, a configuration will be described where a reference image (hereinafter referred to as a correction toner image) is formed on the intermediate transfer body 5.

Figure 2:
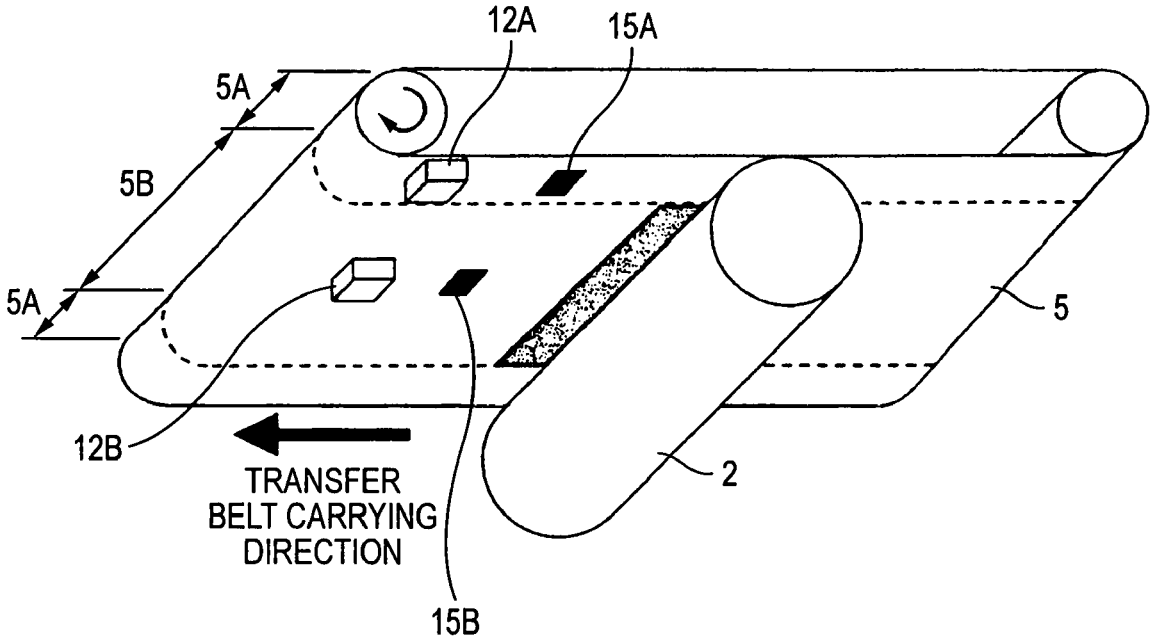
FIG. 2 is a configuration diagram showing an exemplary embodiment of a toner adhesion amount detection mechanism in the image forming apparatus.

The physical quantity of a correction toner image formed on the intermediate transfer body 5 is measured by a measurement unit 12. In this embodiment, the physical quantity is a toner adhesion amount. As shown in FIG. 2, the toner adhesion amount sensors 12A and 12B of the measurement unit 12 are arranged in close proximity to the intermediate transfer body 5. FIG. 2 also shows a photoreceptor 2.

Referring to FIG. 2, a sign 5A represents the regions at both ends of the intermediate transfer body 5 in its width direction, that is, the outer regions of the maximum form area in a direction orthogonal to the carrying direction on the intermediate transfer body 5. A sign 5B represents the region in the center of the intermediate transfer body 5 in its width direction, that is, the inner region of the maximum form area of the intermediate transfer body 5 in its width direction. As the measurement unit 12, total two toner adhesion amount sensors are arranged. A toner adhesion amount sensor 12A detects a correction toner image 15A formed in the outer region of the maximum form area. A toner adhesion amount sensor 12B detects a correction toner image 15B formed in the inner region of the maximum form area.

Figure 3:
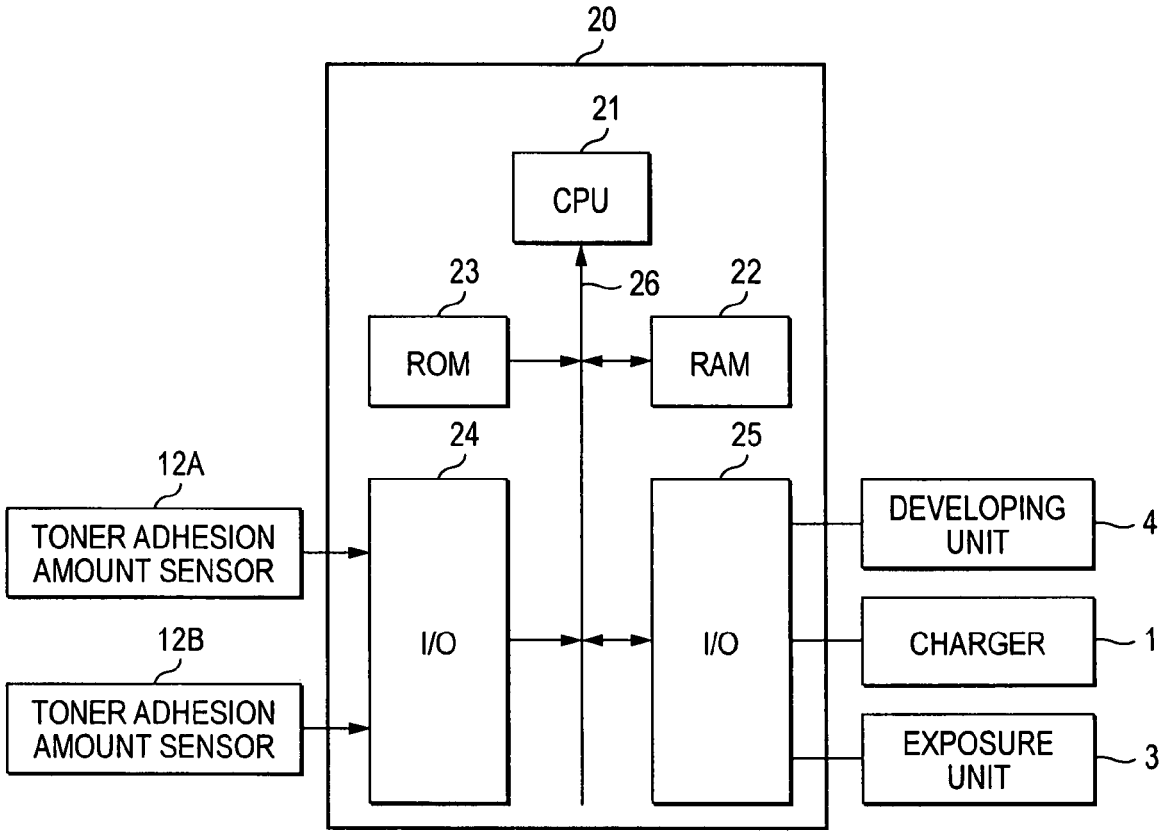
FIG. 3 is a block diagram showing an exemplary embodiment of a controller in the image forming apparatus.

Next, an exemplary configuration of a controller 20 in the embodiment will be described referring to FIG. 3. The controller 20 includes a CPU 21, a RAM 22, a ROM 23 and I/O ports 24, 25. Detection signals from the toner adhesion amount sensors 12A, 12B are applied to the CPU 21 via the I/O port 24 and a common bus 26. The ROM 23 stores therein a program for calculating the correction conditions for the toner adhesion amount. The CPU 21 executes the program to calculate the correction conditions. Based on the calculation result, a control signal is transmitted to a developing unit 4, a charger 1 and an exposure unit 3 via the I/O port 25 from the CPU 21. The control signal is used to control the laser exposure amount of the exposure unit 3, the development bias voltage of the developing unit 4, and the charging bias voltage of the charger 1.

An example of control program will be described referring to FIGS. 4A, 4B and 4C.

Figure 4A:
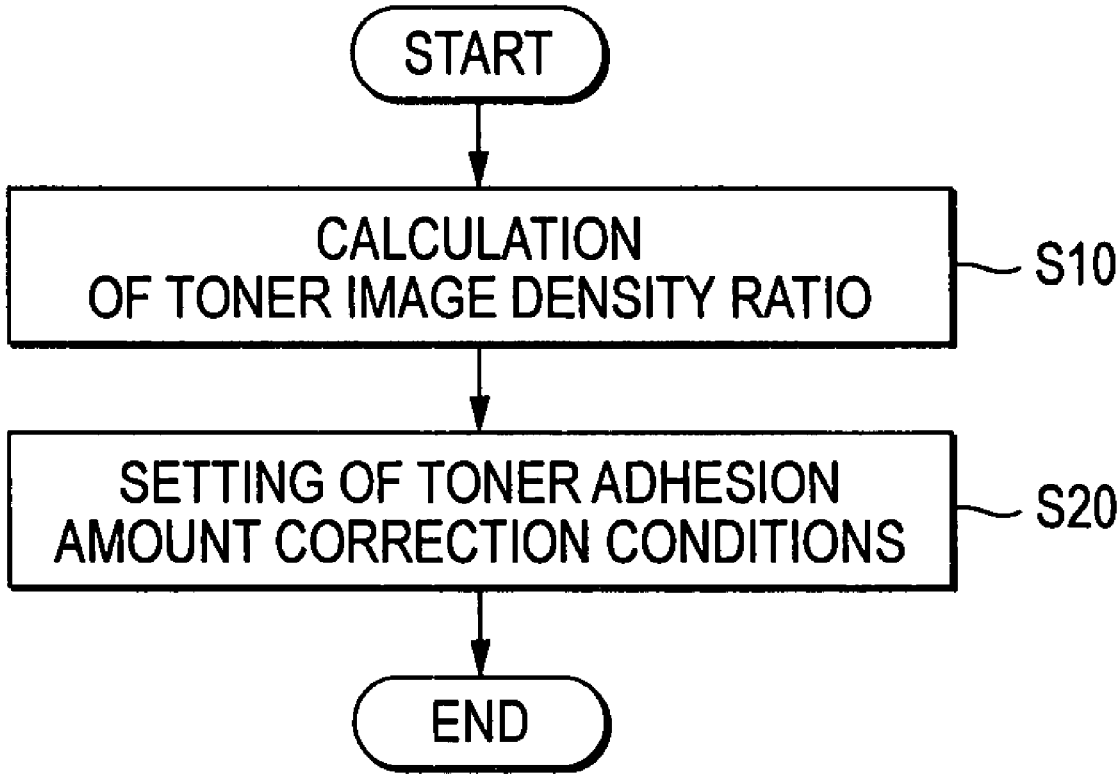
FIG. 4A is a flowchart showing a flow of control in the controller in the image forming apparatus.

As shown in FIG. 4A, control in the embodiment is roughly divided into two types of processing: toner image density ratio calculation processing S10 and toner adhesion amount correction condition setting processing S20.

Figure 4B:
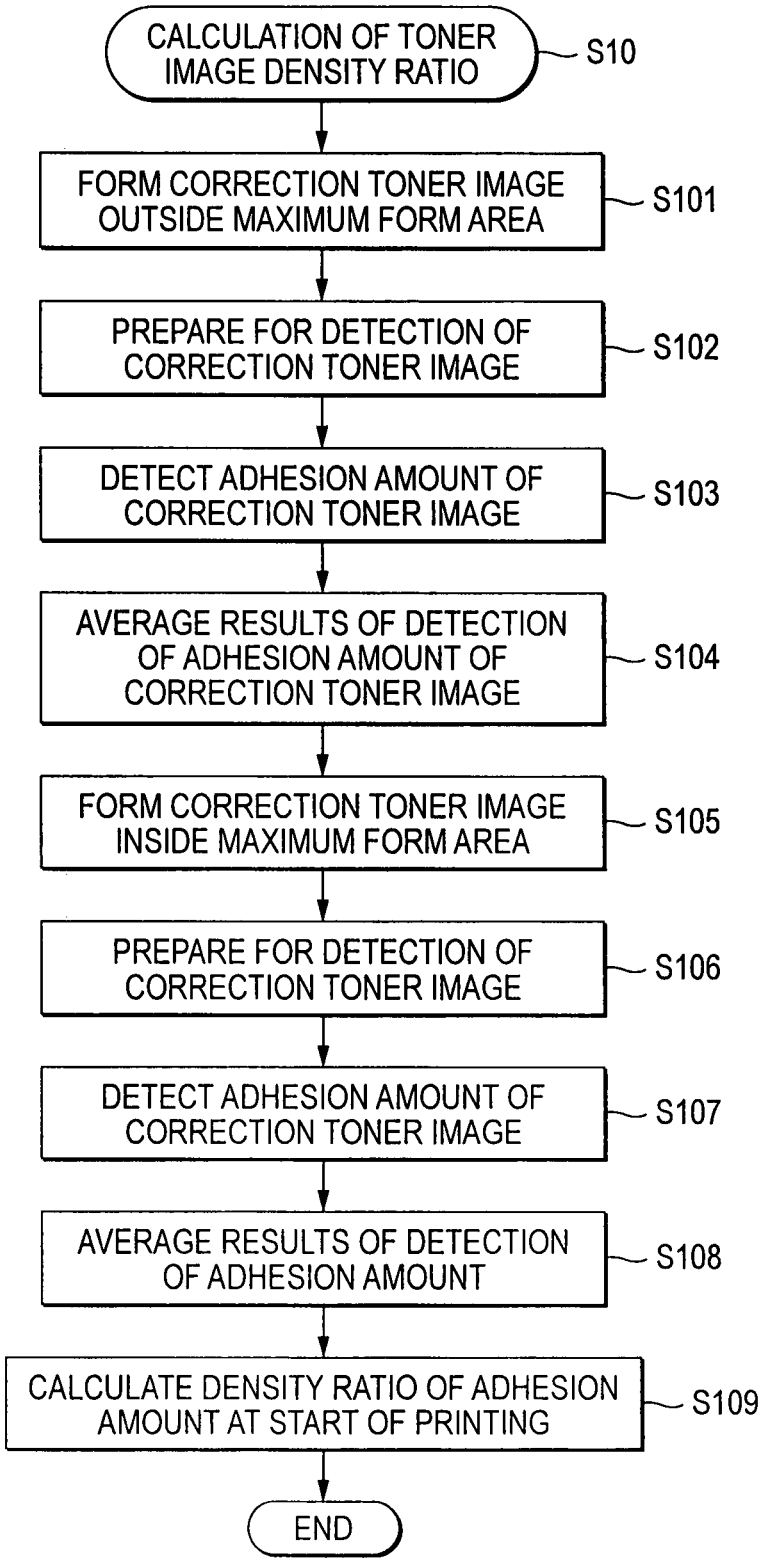
FIG. 4B is another flowchart showing a flow of control in the controller in the image forming apparatus.
Figure 4C:
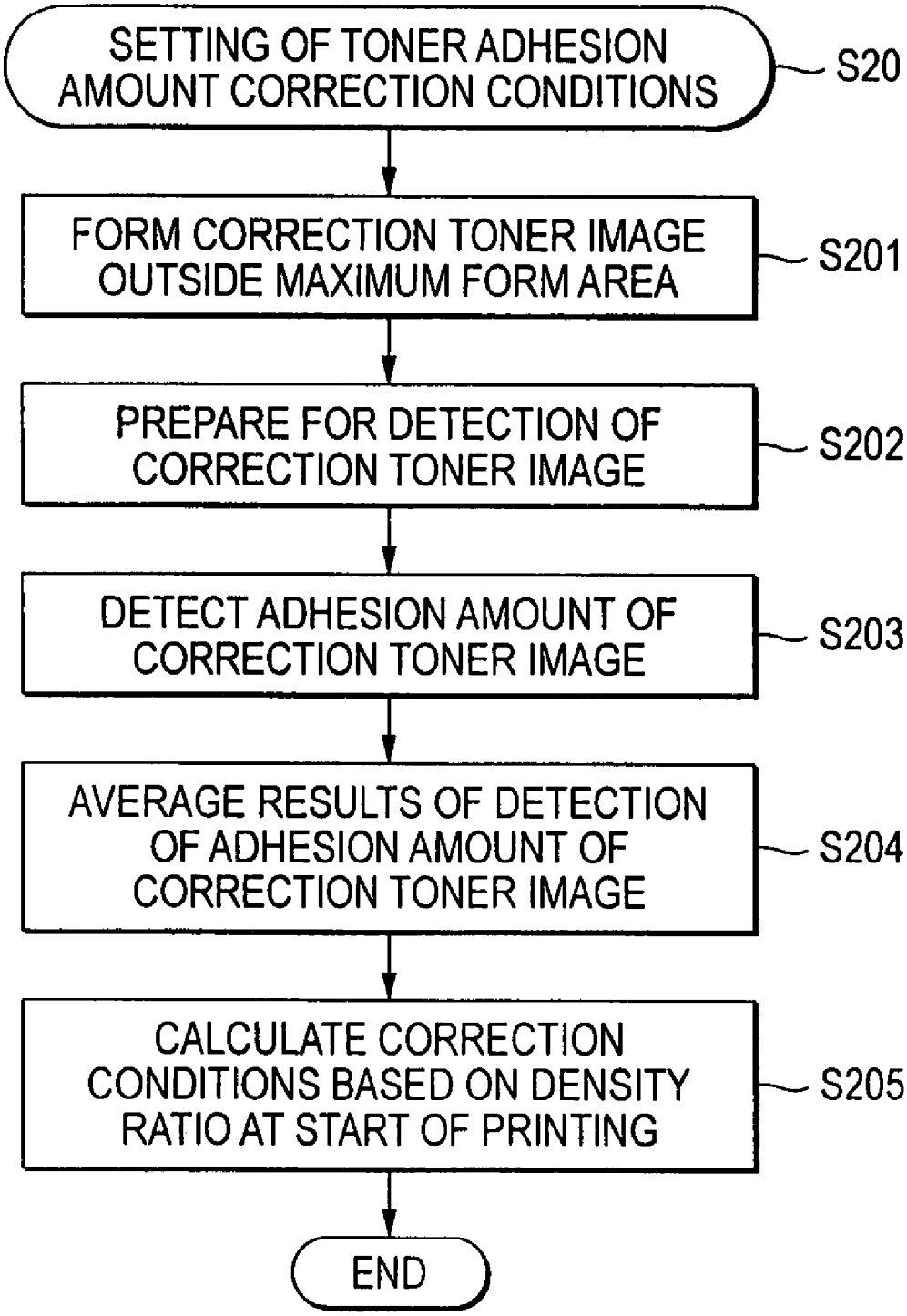
FIG. 4C is still another flowchart showing a flow of control in the controller in the image forming apparatus.
Figure 5:
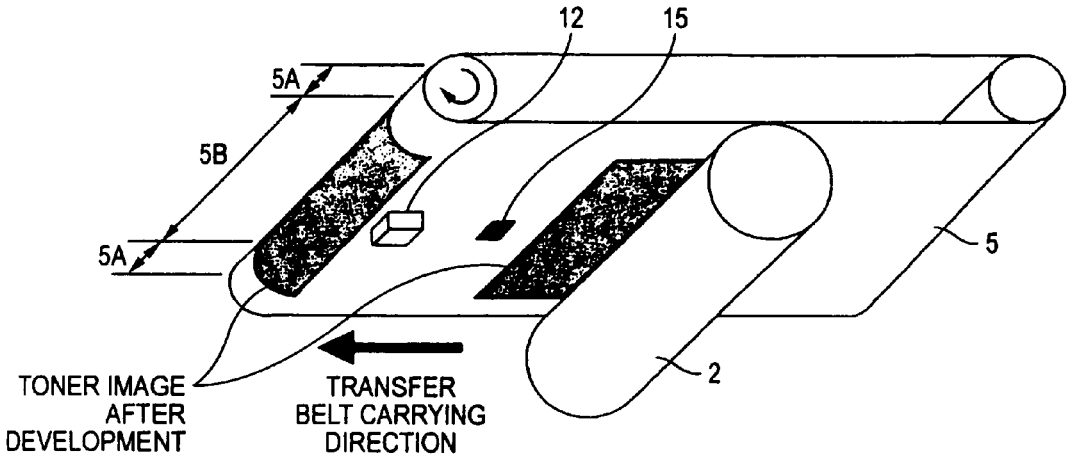
PRIOR ART FIG. 5
FIG. 5 is a related art toner adhesion amount detection mechanism.

FIG. 4B shows the details of the toner image density ratio calculation processing S10. The toner image density ratio calculation processing S10 detects, at the start of printing, that is, before continuous web printing, the toner adhesion amount of a toner image in each region by way of a toner adhesion amount sensor 12A in the outer region 5A of the maximum form area on the intermediate transfer body 5 and a toner adhesion amount sensor 12B in the inner region 5B of the maximum form area on the intermediate transfer body 5 in order to obtain a ratio of a toner image density between a toner image 15A in the outer region 5A of the maximum form area on the intermediate transfer body 5 and a toner image 15B in the inner region 5B of the maximum form area on the intermediate transfer body 5.

In step S101, a correction toner image 15A for correcting the toner adhesion amount is formed in the outer region 5A of the maximum form area. In step S102, preparations for detection of the correction toner image 15A are made including setting of the light amount of the adhesion amount sensor 12A in the outer region 5A of the maximum form area. In step S103, the adhesion amount of the correction toner image 15A is detected by the adhesion amount sensor 12A. In step S104, detection signals for several correction toner images 15A from the adhesion amount sensor 12A are averaged to obtain the toner image density of the outer region 5A of the maximum form area.

In step S105, a correction toner image 15B is formed in the inner region 5B of the maximum form area. In step S106, preparations for detection of the correction toner image 15B are made including setting of the light amount of the adhesion amount sensor 12B in the inner region 5A of the maximum form area. In step S107, the adhesion amount of the correction toner image 15B is detected by the adhesion amount sensor 12B. In step S108, detection results of adhesion amount of several correction toner images 15B are averaged. In this way, the image density of the toner in the inner region 5B of the maximum form area is obtained. In step S109, a density ratio is obtained between the average adhesion amount of the toner image in the outer region 5A of the maximum form area and that of the toner image in the inner region 5B of the maximum form area.

Next, a flow of toner adhesion amount correction condition setting processing S20 will be described using FIG. 4C. In step S201, a correction toner image 15A for correcting the toner adhesion amount during continuous web printing is formed in the outer region 5A of the maximum form area of the intermediate transfer body 5. In step S202, preparations for detection of the correction toner image 15A are made including setting of the light amount of the adhesion amount sensor 12A in the outer region 5A of the maximum form area. In step S203, the adhesion amount of the correction toner image 15A is detected by the adhesion amount sensor 12A. In step S204, detection results of adhesion amount of several correction toner images 15A are averaged. Next, in step S205, based on a density ratio between the average adhesion amount of the toner image in the outer region 5A of the maximum form area and the average adhesion amount of the toner image in the inner region 5B of the maximum form area obtained at the start of printing, the adhesion amount of the toner image in the inner region 5B of the maximum form area during printing is calculated and the toner adhesion amount correction conditions are obtained.

When the toner adhesion amount correction conditions are calculated for respective colors, the calculation results are used to set the light amount of the laser beams 103 of the exposure unit 3, the development bias voltage of the developing unit 4 and the charging voltage of the charger 1 and set the toner adhesion amount correction conditions. The toner adhesion amount correction condition setting processing shown in FIGS. 4A to 4C is executed for each color.

As described above, a correction toner image is formed only in the outer region of the maximum form area of the intermediate transfer body and not in the inner region of the maximum form area. This eliminates the need for suspending the printing process. Further, during continuous web printing, the toner adhesion amount of the inner region of the maximum form area is calculated based on the density ratio measured at the start of printing and the toner adhesion amount correction conditions are set based on the calculation result. It is thus possible to correct the toner adhesion amount without being influenced by the secular variation in the resistance value of an intermediate transfer body, thereby providing an image forming apparatus with good printing quality.

The invention is not limited to the foregoing embodiment but may be embodied by a variety of modifications to the components without departing from the spirit and scope of the invention. By combining plural components disclosed in the foregoing embodiment as required, variations of the invention may be formed. For example, some of the components indicated in the embodiment may be deleted. Or, components related to different embodiments may be combined as required.

What is claimed is:

1. An image forming apparatus comprising:

an image carrier that comprises:

a central region on which a target image as an object of an image forming is formed, and a peripheral region placed outward of the central region;

an image forming unit that forms:

a first reference image on the peripheral region and a second reference image on the central region, before the image forming is started, and the target image as the object on the central region based on an image forming condition preset for the image forming and a third reference image on the peripheral region, during the image forming;

a measurement unit that measures a physical quantity of the first reference image, the second reference image and the third reference image; and a controller that corrects the image forming condition based on the physical quantity measured by the measurement unit.

2. The image forming apparatus according to claim 1, wherein the image carrier comprises a photoreceptor, an intermediate transfer body, or recording paper.

3. The image forming apparatus according to claim 1, wherein:

each of the first reference image, the second reference image and the third reference image comprises a toner image;

the measurement unit comprises a toner sensor that senses a toner adhesion amount of the toner image formed on the image carrier; and the physical quantity comprises the toner adhesion amount of the first reference image, the second reference image and the third reference image, which are sensed by the toner sensor.

4. An image forming apparatus comprising:

an image carrier that comprises:

a central region on which a target image as an object of an image forming is formed, and a peripheral region placed outward of the central region;

an image forming unit that comprises:

a photoreceptor, a charging unit that uniformly charges a surface of the photoreceptor, an exposure unit that forms an electrostatic latent image on the surface by irradiating a laser beam, and a developing unit that forms a toner image corresponding to the electrostatic latent image on the surface; and forms:

a first reference toner image on the peripheral region and a second reference toner image on the central region, before the image forming is started, and a target toner image corresponding to the target image on the central region based on an image forming condition preset for the image forming and a third reference image on the peripheral region, during the image forming;

a measurement unit that measures a toner adhesion amount of the first reference toner image, the second reference toner image and the third reference toner image; and a controller that corrects the image forming condition based on the toner adhesion amount measured by the measurement unit.

5. The image forming apparatus according to claim 4, wherein:

the measurement unit measures:

the toner adhesion amount of the first reference toner image as a first toner adhesion amount;

the toner adhesion amount of the second reference toner image as a second toner adhesion amount;

the toner adhesion amount of the third reference toner image as a third toner adhesion amount; and the controller calculates a toner adhesion amount ratio that is a ratio between the first toner adhesion amount and the second toner adhesion amount; and the controller controls the image forming unit to form a next target image by compensating the toner adhesion amount to be included in the next target image based on the toner adhesion amount ratio and the third toner adhesion amount.

6. The image forming apparatus according to claim 5, wherein the image forming unit compensates the toner adhesion amount of the next target image by controlling:

the exposure unit;

the developing unit; and the charging unit.

7. A toner adhesion amount correction method for compensating a toner adhesion amount of a toner image formed by an image forming apparatus comprising:

an image forming unit that forms the toner image, and an intermediate transfer body that comprises a central region on which a target image as the object of an image forming is formed and a peripheral region placed outward of the central region and transfers the toner image formed on the central region by the image forming unit onto a recording medium, the method comprising:

(a) forming a first reference toner image on the peripheral region of the intermediate transfer body;

(b) forming a second reference toner image on the central region of the intermediate transfer body;

(c) detecting the toner adhesion amount of the first reference toner image as a first toner adhesion amount;

(d) detecting the toner adhesion amount of the second reference toner image as a second toner adhesion amount;

(e) calculating a toner adhesion amount ratio that is a ratio between the first toner adhesion amount and the second toner adhesion amount;

(f) forming a third reference toner image on the peripheral region;

(g) detecting the toner adhesion amount of the third reference toner image as a third toner adhesion amount; and (h) estimating the toner adhesion amount of the target image formed on the central region as a fourth toner adhesion amount based on:

the toner adhesion amount ratio, and the third toner adhesion amount.

8. The toner adhesion amount correction method according to claim 7, further comprising:

(i) controlling the image forming unit to form a next target image by compensating the toner adhesion amount to be included in the next target image based on the fourth toner adhesion amount.

9. The toner adhesion amount correction method according to claim 7, wherein:

the image forming unit comprises:

a photoreceptor, a charging unit that uniformly charges a surface of the photoreceptor, an exposure unit that forms an electrostatic latent image on the surface by irradiating a laser beam, and a developing unit that forms a toner image corresponding to the electrostatic latent image on the surface; and the image forming unit compensates the toner adhesion amount of the next target toner image by controlling:

the exposure unit;

the developing unit; and the charging unit.

* * * * *